United States Patent [19]

Caro et al.

[11] Patent Number: 4,698,028

[45] Date of Patent: Oct. 6, 1987

[54] COAXIAL CABLE CONNECTOR

[75] Inventors: Edward R. Caro, Monterey Park; Walter J. Bonazza, La Canada, both of Calif.

[73] Assignee: The United States of America as represented by the Administrator of the National Aeronautics and Space Administration, Washington, D.C.

[21] Appl. No.: 904,513

[22] Filed: Sep. 8, 1986

[51] Int. Cl.[4] ..... H01R 13/52

[52] U.S. Cl. ..... 439/271; 439/578

[58] Field of Search ..... 339/59, 60 C, 60 M, 339/61 R, 61 M, 63 R, 63 M, 177 R, 177 E, 89 C, 90 C, 200 R, 201, 213 R

[56] References Cited

U.S. PATENT DOCUMENTS

| | | | |
|---|---|---|---|
| 1,969,866 | 8/1934 | Wild et al. | 339/60 C |
| 2,883,640 | 4/1959 | Duenke | 339/202 |
| 2,937,360 | 1/1960 | True | 339/177 R |
| 3,106,599 | 10/1963 | Leitner, et al. | 174/12 |
| 3,322,883 | 5/1965 | Lusk | 174/73 |
| 3,361,430 | 8/1965 | Reid | 277/26 |
| 3,413,407 | 11/1968 | Potter | 174/89 |
| 3,439,294 | 5/1968 | Flanagan et al. | 333/33 |
| 3,514,741 | 5/1970 | Noren | 339/177 R |
| 3,963,297 | 6/1976 | Panek et al. | 339/94 M |
| 4,373,767 | 2/1983 | Cairns | 339/94 C |
| 4,545,633 | 10/1985 | McGeary | 339/42 |

FOREIGN PATENT DOCUMENTS

| | | | |
|---|---|---|---|
| 746998 | 3/1933 | France | 339/177 R |
| 778781 | 7/1957 | United Kingdom | 177 R/ |

*Primary Examiner*—John McQuade
*Assistant Examiner*—David Pirlot
*Attorney, Agent, or Firm*—Paul F. McCaul; John R. Manning; Thomas H. Jones

[57] ABSTRACT

A coaxial cable connector is provided, which resists radio-frequency breakdown in coaxial cables used in the vacuum of outer space. The connector body surrounds an insulator which includes an easily compressible elastomeric portion. An insulated coaxial cable is prepared so its insulation projects beyond the outer conductor and compresses the elastomeric portion of the connector insulator.

6 Claims, 2 Drawing Figures

COAXIAL CABLE CONNECTOR

ORIGIN OF INVENTION

The invention described herein was made in the performance of work under a NASA contract, and is subject to the provisions of Public Law 96-517 (35 USC 202) in which the Contractor has elected not to retain title.

BACKGROUND OF THE INVENTION

Coaxial cable systems used to carry RF (radio-frequency) power in outer space are often provided with an insulation between the outer and center conductors to prevent RF breakdown. Such cable insulation tends to develop gaps or voids at the interfaces between various insulators or dielectric elements, as a result of thermal cycling, aging, and manufacturing tolerances. Wherever a void has developed along such a coaxial system, breakdown can occur when the system is carrying RF power. One cause for breakdown in such a gap, occurs when the pressure of air in the gap has dropped from atmospheric to between 0.01 and 0.1 Torr. At such a pressure range, the radio-frequency voltage between the inner and outer conductors can cause the low pressure air to ionize, become hot, and form a carbon track which feeds on itself and leads to catastrophic failure. If air in the void fully vents to the vacuum of outer space, on the order of 0.001 Torr or lower, then there is the possibility of multipactor breakdown, which is a secondary electron resonance phenomenon which rapidly develops into ionization and catastrophic failure. These problems have been observed in many spaceborn RF systems. A coaxial cable connector or connection system which avoided the development of gaps despite thermal cycling, aging, and manufacturing tolerances, would be valuable in assuring the reliable operation of RF systems, especially those used in the vacuum of outer space.

SUMMARY OF THE INVENTION:

In accordance with one embodiment of the present invention, a connector is provided for connection to the end of an insulated coaxial cable, which resists the formation of gaps in the insulation between the outer and center conductors. The connector includes an electrically-conductive housing with front and rear ends and a passage therewithin. A connector insulator which lies in the passage has an elastomeric rear end portion. The cable is held to the connector housing so the cable insulation projects into the passage and compresses the elastomeric insulation portion. Thus, if the cable insulation shrinks or expands, the elastomeric portion of the connector insulator takes up such shrinkage and expansion, to prevent the formation of a gap between the outer and center conductors where RF (radio-frequency) breakdown can occur.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
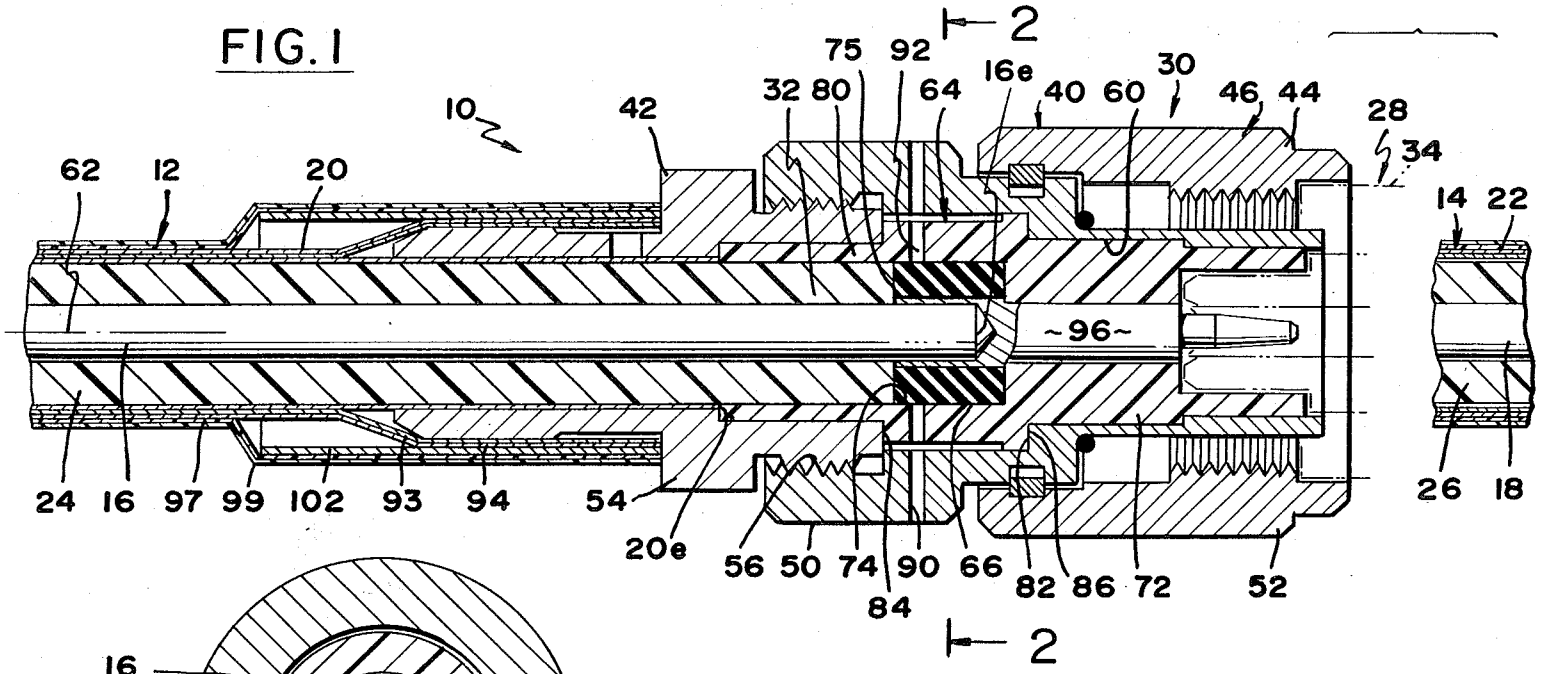
FIG. 1 is a sectional view of a cable and connector assembly constructed in accordance with the present invention.
Figure 2:
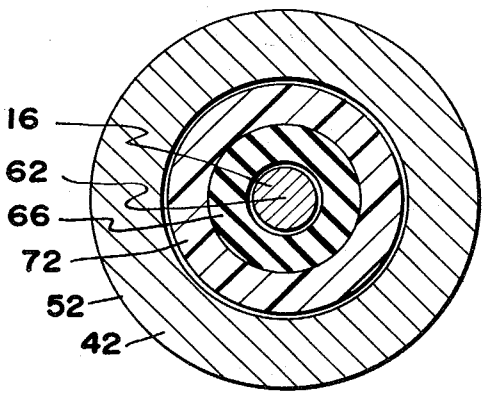
FIG. 2 is a view taken on the line 2—2 of FIG.

FIG. 1 illustrates a connection system 10 wherein two insulated coaxial cables 12, 14 are connected so their center conductors 16, 18 and outer conductors 20, 22 are in electrical connection. This particular system is designed to carry high frequency power in a high vacuum environment such as in outer space. To prevent breakdown which can occur in that environment, each cable has a cable insulator 24, 26. The cables are interconnected by a connector system 28 which includes one connector apparatus or connector 30 for connecting to the end 32 of one cable, and also to another connector 34 which connects to the end of the other cable 14. In order to prevent breakdown, it is important that insulation lie between the inner and outer conductors along the entire interconnection between the cables, with no gap in the insulation through which breakdown can occur. Such gaps can occur because of shrinkage of a cable insulation such as 24 with age, expansion or contraction with temperature changes, and as a result of manufacturing tolerances.

The connector 30 includes an electrically conductive housing 40 with rear and front ends 42, 44. The housing is formed by a body 46 having a pair of rotatably coupled elements 50, 52, and a rear fitting 54 which is threadably engaged with a threaded rear end 56 of the body. The housing 40 forms a passage 60 extending along a connector axis 62. A connector insulator 64 lies in the passage, to insulate the central conductor 96 of the connector from the electrically conductive housing 40.

In accordance with the present invention, the connector insulator 64 includes an elastomeric portion or part 66 which is normally compressed in a direction along the axis 62 of the connector. As a result, if a cable insulation such as 24 shrinks, as because of aging, so it withdraws from the connector, the elastomeric part 66 expands to avoid the creation of a gap in the insulation through which breakdown can occur. The elastomeric part 66 lies at the rear end of the connector insulation, to bear directly against the cable insulation 24. If there are manufacturing tolerances which would otherwise cause the end of the cable to not be accurately flat, no gap will open because the elastomeric connector insulation part will fill any indentations at the end of the cable insulation. The elastomeric part 66 can be formed of a plastic foam, silicone rubber (for a higher dielectric constant), or other elastomeric material.

The end of the coaxial cable 12 is prepared for attachment to the connector 30 by removing the outer conductor 20 from around the cable insulation 24 at the end of the cable. The cable insulation includes a projecting end portion or end 32 that projects beyond the end **20*e* of the cable outer conductor. The cable outer conductor is attached to the connector rear fitting 54 to make mechanical and electrical connection with the fitting. The projecting insulation end 32 of the cable insulation projects deeper into the connector than the cable outer conductor, and the projecting insulation end directly abuts the elastomeric part 66** of the connector insulator.

The connector insulator 64 includes not only the elastomeric part 66, but a second part 72 which extends forward of the elastomeric part. The second part 72 includes a recess 74 which has a width that permits it to closely receive the elastomeric part 66 and also the end of the projecting cable insulation portion 32. As a result, the interface 75 between the tip or extreme forward end of the projecting cable insulation portion 32 and the rear end of the elastomeric connector insulator part 66, is protected against the opening of any gap, by the overlapping walls 80 of the second insulator part at its recess.

The connector housing forms rearwardly and forwardly facing shoulders 82, 84 and the second insulator part 72 forms a pair of corresponding ledges 86 that abut the shoulders to keep the second insulator part in the housing. The distance between the shoulder 82, 84 determines the amount of initial compression of the elastomeric portion 66 of the connector insulator. As the rear fitting 54 is screwed into the threaded rear end 56 of the housing body, it approaches and then abuts the rearmost one of the ledges 86 on the connector insulator, at which point the fitting encounters resistance to further turning. The projecting cable insulation portion 70 has then compressed the elastomeric portion 66 by the desired amount.

The elastomeric connector portion 66 is preferably vented to the outside, to permit the rapid venting of air in the passage when the connector is introduced into a vacuum, and also thereafter permit the escape of vapors that can be produced by the elastomeric connector insulation portion. To enable such escape, the housing and second insulator parts have aligned holes 90, 92 that form a vent extending from the environment outside the housing to the outside of the elastomeric insulation portion 66, and the recess 74. Thus, any deep pockets of air, as well as vapors, are vented.

The coaxial cable 12 is prepared for attachment to the connector 30 as by cutting a foil shield 93 and braided shield 94 of the outer conductor 20 and a plastic cable jacket 97 around the outer conductor. The end of the cable insulator is trimmed back to leave the forward end 16*e* of the center conductor projecting forward of the cable insulation to enable its attachment to the connector center conductor 96. The outer conductor 20 is then mechanically and electrically mounted to the rear fitting 54. This can be accomplished by inserting the foil and braided shields 93, 94 in the rear fitting and squeezing the shields between a sleeve 102 and the rear of the fitting 54, and also by soldering the parts together. The cable jacket 97 lies about the sleeve 102 and a heat shrinkable layer 99 is shrunk. Then the fitting 54 with the front end of the trimmed cable thereon is inserted into the connector body 46, and the body is screwed onto the fitting until the shoulder 84 at the front end of the fitting firmly abuts the rear ledge 86 of the connector insulation.

Thus, the invention provides a connection system for connecting a coaxial cable of the type that includes a cable insulation, to another coaxial conductor such as a connector. Gaps between the insulation of the cable and the connector insulator or the like are avoided by the use of a connector insulator which includes an elastomeric portion that abuts the forward tip of the cable insulation. The connector insulator also preferably includes a part with a recess which receives the compressed elastomeric insulator portion as well as the forward tip of the cable insulation, to protect against the possibility of any gap at their interface. The connection is useful for a connector that mates with another connector, or any other insulated coaxial cable interconnection.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector apparatus useful to connect the end of a coaxial cable to another connector apparatus, comprising:

a coaxial cable having center and outer conductors and a cable insulator between them;

an electrically conductive housing having rear and front ends and forming a passage between its ends, said rear end constructed to mechanically and electrically connect to the outer conductor at the end of said coaxial cable;

an electrically conductive center connector conductor having a rear end for connecting to the center conductor of said coaxial cable;

a connector insulator lying within said passage, and having a hole through which said center connector conductor extends at least partially;

said connector insulator including an elastomeric portion positioned to be compressed by the cable insulator of said coaxial cable, whereby to avoid gaps arising from axial shrinkage of said insulator of said coaxial cable;

said cable insulator has an end portion that projects forwardly beyond said cable outer conductor, and said elastomeric insulator portion comprises an elastomeric first insulator part which abuts the projecting end portion of said cable insulator, the rearward portion of said passage having a greater width than the outside of said cable insulator end portion and the outside of said elastomeric insulator part; and said connector insulator includes a second insulator portion lying in said passage, and having a rear portion that extends around both said elastomeric first insulator part and at least part of the projecting end of said cable insulator.

2. The apparatus described in claim 1 wherein:

the forward end of said coaxial cable extends along a predetermined axis;

said body and second insulator part each has a vent passage, said passages aligned and extending primarily perpendicular to the length of said axis, from the outside of said body to said elastomeric part.

3. A connector apparatus useful to connect the end of a coaxial cable, which includes a cable insulator between the center and outer cable conductors, to another connector apparatus which has center and outer conductors, comprising:

an electrically conductive housing having rear and front ends and forming a passage between its ends, said rear end constructed to mechanically and electrically connect to the outer conductor at the end of said coaxial cable;

an electrically conductive center connector conductor having a rear end for connecting to the center conductor of said coaxial cable;

a connector insulator lying within said passage, and having a hole through which said center connector conductor extends at least partially;

said connector insulator including an elastomeric portion positioned to be compressed by the cable insulator of said coaxial cable, whereby to avoid gaps arising from axial shrinkage of said insulator of said coaxial cable;

said housing includes a body with a threaded rear portion and also includes a rearwardly-facing internal shoulder, said housing also including a rear fitting threadably engaged with said threaded body portion and forming a forwardly-facing shoulder;

said connector insulator includes a second insulator portion extending between and against said shoulders, said second insulator portion having a recess at its rear end, said recess having a bottom;

said elastomeric portion of said connector insulator lying in said recess and having one end against the bottom of the recess and an opposite end against the cable insulator, whereby the second insulator portion limits how far forward the rear fitting is turned to limit the degree of initial compression of the elastomeric insulator portion.

4. A coaxial connector apparatus for connection to an end of a coaxial cable which has outer and center conductors and a cable insulation between them, comprising:

an electrically conductive connector housing which has front and rear ends and a passage extending into the rear end toward the front end along an axis;

a connector insulator lying in said housing and having forward and rearward ends, and having an elastomeric portion at its rear end, said connector insulator having means for limiting its forward movement within said housing;

said housing including a body with front and rear end portions said body surrounding at least part of said connector insulator, and a fitting which is attachable to the outer cable conductor, said fitting attachable to the rear end portion of said body at a position to hold said cable insulation so it compresses said elastomeric portion of said connector insulator;

said elastomeric portion comprises a first insulator part, and said connector insulator includes a second insulator part which is more rigid than said first part and that has a rear end forming a recess that receives said elastomeric first insulator part, said recess being deeper along said axis than the length of said first elastomeric insulator part therealong, so the recess also receives the end of said coaxial cable insulation.

5. The apparatus described in claim 4 wherein:

said housing body and second insulator part have aligned holes forming a vent extending largely perpendicular to said axis, between the recess in said second insulator part and the outside of said body.

6. The apparatus described in claim 4 including:

said coaxial cable having said outer conductor connected to said fitting and said cable insulation projecting beyond said outer conductor into said recess and compressing said first insulator part.

* * * * *